United States Patent [19]

Demler, Jr. et al.

[11] Patent Number: 4,875,865

[45] Date of Patent: Oct. 24, 1989

[54] COAXIAL PRINTED CIRCUIT BOARD CONNECTOR

[75] Inventors: Henry W. Demler, Jr., Lebanon, Pa.; Frank P. Dola, Hudson, Fla.; David J. Kimmel, Clearwater, Fla.; Thomas J. Sotolongo, Clearwater Beach, Fla.

[73] Assignee: AMP Incorporated, Harrisburg, Pa.

[21] Appl. No.: 220,141

[22] Filed: Jul. 15, 1988

[51] Int. Cl.[4] ..... H01R 4/66

[52] U.S. Cl. ..... 439/101; 439/578

[58] Field of Search ..... 439/101, 109, 608, 92, 439/94, 98, 102–108, 578, 581

[56] References Cited

U.S. PATENT DOCUMENTS

| | | | |
|---|---|---|---|
| 3,036,285 | 5/1962 | Smith | 439/107 |
| 3,237,146 | 2/1966 | Barker | 439/101 |
| 3,587,028 | 6/1971 | Uberbacher | 339/14 |
| 3,824,528 | 7/1974 | Esser | 439/578 |
| 3,852,700 | 12/1974 | Haws | 439/98 |
| 3,927,925 | 12/1975 | Borsuk | 439/109 |
| 4,020,430 | 4/1977 | Vander Heyden | 439/608 |
| 4,362,350 | 12/1982 | von Harz | 439/608 |
| 4,453,798 | 6/1984 | Asick et al. | 439/581 |
| 4,475,781 | 10/1984 | Asick | 339/17 LM |
| 4,519,665 | 5/1985 | Althouse et al. | 439/608 |
| 4,568,133 | 2/1986 | Amano et al. | 439/108 |
| 4,624,515 | 11/1986 | Brush, Jr. et al. | 439/608 |
| 4,627,674 | 12/1986 | Hamsher, Jr. | 339/14 P |
| 4,655,518 | 4/1987 | Johnson | 339/17 LC |
| 4,666,231 | 5/1987 | Sheesley | 339/177 R |
| 4,737,116 | 4/1988 | Slye et al. | 439/92 |

OTHER PUBLICATIONS

IBM Technical Disclosure Bulletin, vol. 10, No. 3, Aug. 1967.

*Primary Examiner*—Gary F. Paumen
*Attorney, Agent, or Firm*—Robert W. Pitts

[57] ABSTRACT

A coaxial electrical connector assembly including an insulative housing having a ground plate with a plurality of apertures sized to receive signal contacts without contact with the ground plate and other apertures sized to engage ground terminals is disclosed. Tabs formed by slits are deflected by the ground terminals inserted into these apertures. This coaxial connector can be employed as an input or output to signal and ground pins used in a backplane connector which form part of a backplane connector assembly for interconnection of a plurality of daughterboards to a motherboard.

18 Claims, 9 Drawing Sheets

Fig. 10
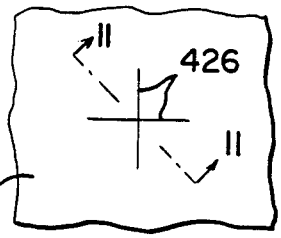
Fig. 11
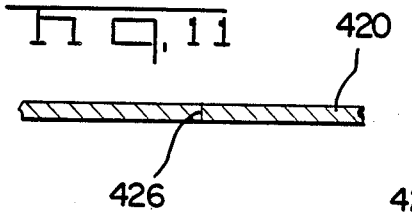
Fig. 13
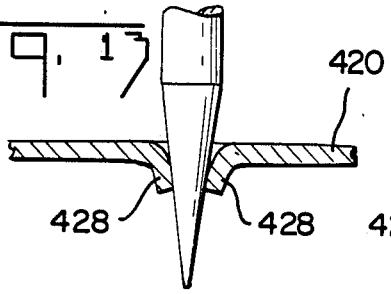
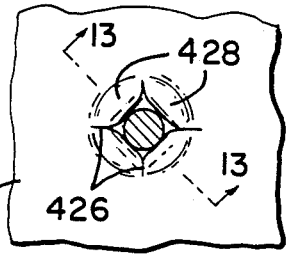
Fig. 12
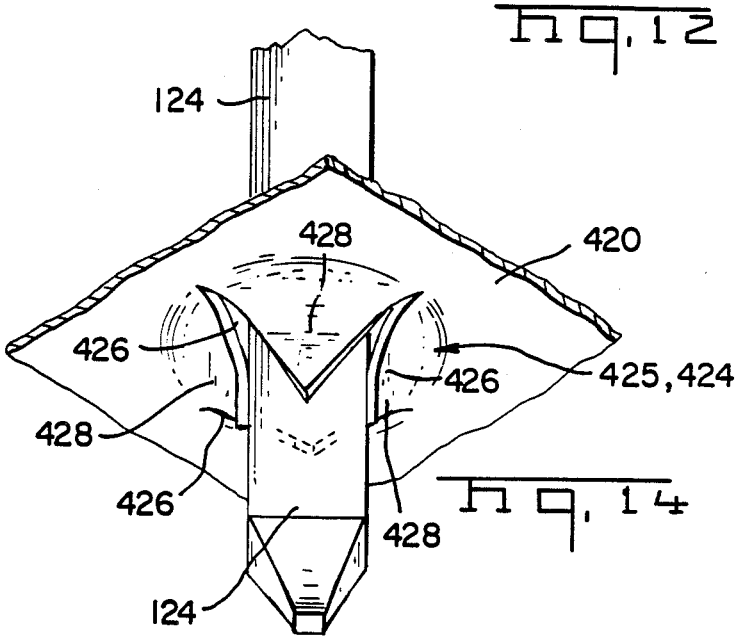
Fig. 14

COAXIAL PRINTED CIRCUIT BOARD CONNECTOR

BACKGROUND OF THE INVENTION

1. Field of the Invention

This invention relates to an electrical connector for establishing signal interconnections to orthogonal printed circuit boards and to a backplane connector assembly interconnecting daughterboards to a daughterboard.

2. Description of the Prior Art

U.S. Pat. No. 4,655,518 discloses a backplane/daughterboard connector comprising two mating connector halves with mating signal pins and signal receptacles. That connector is intended to provide for the transmission of high frequency electrical signals. Ground contacts are provided adjacent the sidewalls of the housing and adjacent one of the plurality of rows of signal contacts.

The high density controlled impedance connector shown in U.S. patent application Ser. No. 096,792 filed Sept. 11, 1987, a continuation of U.S. patent application Ser. No. 866,518 filed May 23, 1986, now abandoned, discloses another connector for establishing an electrical connection between signal pins in high frequency applications. Unlike the connector shown in U.S. Pat. No. 4,655,518, the connector shown in this last mentioned application provides not only for the interconnection of a plurality of signal contacts without significant changes in impedance, but also provides a means for transmitting power between a motherboard and an orthogonal daughterboard.

These prior art connectors can employ conventional through hole or surface mount pin interconnection means to establish signal interconnections between a motherboard and signal pins in the motherboard connectors. Signals are distributed to the daughterboards through the daughterboard signal connector pins which mate with corresponding pins in the motherboard connector. These prior art assemblies do not, however, disclose sample means for transmitting high frequency signals directly to the pins in the motherboard without significant changes in impedance, except through the motherboard. One way of transmitting such high frequency signal would be to employ coaxial cables. The instant invention comprises an electrical connector for interconnecting a plurality of individual coaxial cables to pins in the motherboard. In this way, these high frequency signals need not be input into the motherboard connector through traces on the motherboard. Furthermore, these signals can be transmitted between motherboards through the cables. The preferred embodiment of this invention could also be used to interconnect plural motherboards.

SUMMARY OF THE INVENTION

An electrical connector assembly for interconnecting a plurality of coaxial conductors to an array of ground and signal pins in a printed circuit board includes a plurality of signal contacts and ground contacts attached to the signal conductors and the braid of the individual coaxial conductors. The connector assembly also includes a ground plate which has a plurality of apertures. The signal contacts can extend through apertures which are larger than the signal contacts without establishing electrical contact with the ground plate. The ground contacts, however, extend through apertures which are smaller than the individual ground contacts and by all ground contacts are commoned by the ground plate. Other small apertures are aligned with the ground pins in the array and these ground pins are also commoned to the ground plate. The apertures where contact to the ground contacts and ground pins is made can be formed by transverse slits which define deflectable tabs which engage ground pins and contacts inserted through the ground plate.

BRIEF DESCRIPTION OF THE DRAWINGS

FIG. 3 is a perspective view of the motherboard backplane connector.

FIGS. 10–14 show the manner in which spring contacts are formed in the ground plate.

DETAILED DESCRIPTION OF THE PREFERRED EMBODIMENT

Figure 1:
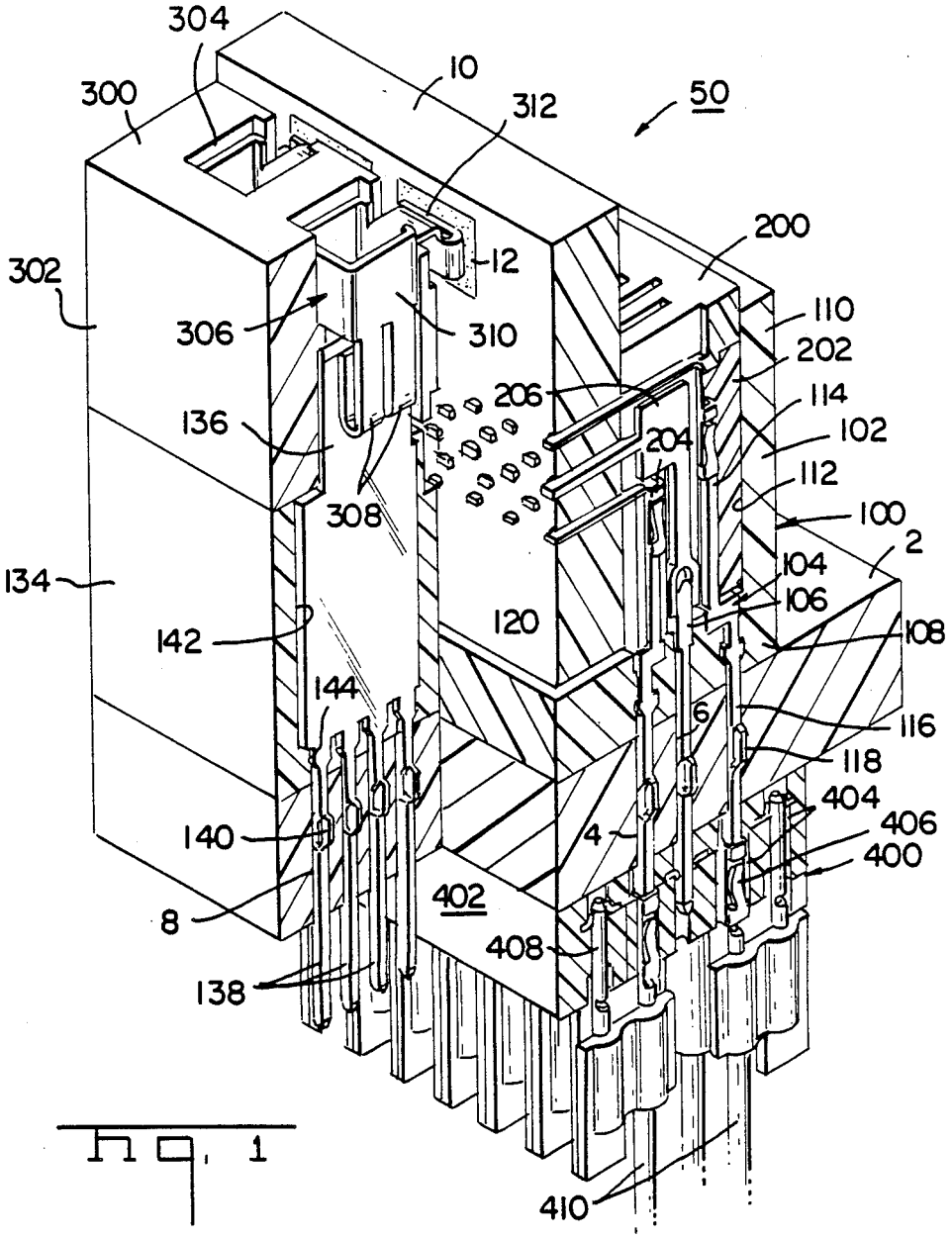
FIG. 1 is a perspective view of one embodiment of a backplane connector assembly including a motherboard backplane connector, a daughterboard signal connector, a daughterboard power connector and a coaxial input connector, all assembled to a motherboard and one daughterboard.

The backplane connector assembly comprising the preferred embodiment of this invention is intended to establish an interconnection between two orthogonal printed circuit boards employed in a backplane assembly used in a computer or similar electronic component. The connector assembly comprising the preferred embodiment of this invention is intended to interconnect both power and signal to both boards. The connector assembly includes a backplane connector assembly 50 consisting of a motherboard backplane connector 100 and daughterboard backplane signal and power, 200 and 300 respectively, connectors for making signal interconnections and for interconnecting power to both the motherboard 2 and to one or more daughterboards 10. This connector assembly is suitable for use with signal contacts spaced apart by a distance of 0.050 inch and can be employed using power contacts intended to deliver 5 amps to both the motherboard 2 and to the daughterboard 10.

A separate connector 400 can be employed to interconnect signal circuit conductors to the motherboard 2 and to the backplane signal connector used on the motherboard. The preferred embodiment of this invention employs a coaxial motherboard signal connector 400. It should be understood, however, that more conventional means of interconnecting signal conductors to the motherboard 2 can also be employed, for example individual signal wires can be soldered or wire-wrapped directly to the pins employed in this assembly. Separate power connectors, one a part of the motherboard backplane connector 100 and the other 300 attached to the daughterboard, are employed.

Not only will the connector assembly comprising the preferred embodiment of this invention depicted herein deliver both power and signals to a backplane assembly consisting of a motherboard 2 and one or more daughterboards 10, but this connector assembly can also be employed in a manner such that the impedance of the signals transmitted through the connector assembly will match the impedance of the component with which the back plane assembly is used. For example, the preferred embodiment of this invention is intended for use in a backplane connector assembly in which a controlled impedance of 75 ohms is required.

The individual components of this connector assembly will now be described individually in more detail.

Coaxial Motherboard Signal Input Connector (See FIGS. 1, and 4A–4C)

The coaxial connector 400 employed to interconnect the signal conductors 410 to the motherboard 2 consists of a housing 402 formed of a material such as Ryton. The housing 402 has a plurality of apertures 404. Each aperture 404 receives either a signal receptacle contact 406 or braid contact ground pins contacts 408. The signal receptacle 406 can be interconnected to the center conductor 412 of a conventional coaxial cable 410 by crimping, and the ground pins 408 can be crimped to the outer braid 414 surrounding the center signal conductor 412. The signal contacts 406 and ground contacts 408 attached to one coaxial cable are at least partially embedded within an insulative sleeve 434. The coaxial connector also has a ground plane 420 formed of a conductive material. This ground plane 420 has a plurality of resilient contact apertures 424. These contact apertures 424 are formed by orthogonal slits 426 cut into the conductive plate 420. Since the ground pins 408 attached to the coaxial conductor braids 414 extend upwardly beyond the signal receptacle contacts 406, the ground pins 418 can be inserted into these contact apertures 424 to engage the aperture tabs or flaps 428 formed by the orthogonal slits 426. Similar apertures 425 are positioned to contact ground pins 124. The contact apertures 424 and 425 are formed so that aperture tabs or flaps 428 at apertures 424 extend upwardly and similar tabs or flaps extend downwardly at apertures 425. The apertures are formed by first slitting the ground plate 420. These slits will cross at each aperture. In the preferred embodiment, Cruciform slits are defined to form four separate tabs or flaps 428 which then act as four independent springs. The tabs or flaps are formed in the following manner. The slits are first defined by either forming score lines extending partially through ground plate 420 or shear lines extending completely through the ground plate. A punch is then used to deflect the tabs or flaps. As the tabs or flaps are deflected by the punch, the slits can propagate outwardly to make room for the punch. More spring force can be provided by using a circular punch to form a radiused, curved or arcuate contour or surface on each separate tab or flap. When a pin 124 is inserted through the corresponding aperture, the side of the respective flap will engage the side of the pin. (See FIGS. 10A–10C.) The ground plane 420 also has a plurality of circular holes 422 which are in alignment with the receptacle contacts 406. The receptacle contacts 406 do not, however, extend through the circular openings 422 formed in the ground plane 420.

The ground plane 420 is, in turn, embedded within the insulative housing 402 comprising a base member 430 and a cover 432. Cutouts 436 conforming to the shape of insulative sleeves 434 are located in the lower surface of base member 430. The configuration of the circular apertures 422 in the ground plane is arranged to correspond to the configuration of the pins 116 in the motherboard backplane connector 100 and is the same configuration as the openings in the motherboard 2 through which these pins 116 are inserted. The ground plane 420 thus serves to interconnect all of the braids 414 of the individual coaxial conductors 408 to the ground in the motherboard backplane connector 100, without shorting the signal conductors 412 or signal receptacle contacts 406.

Figure 2:
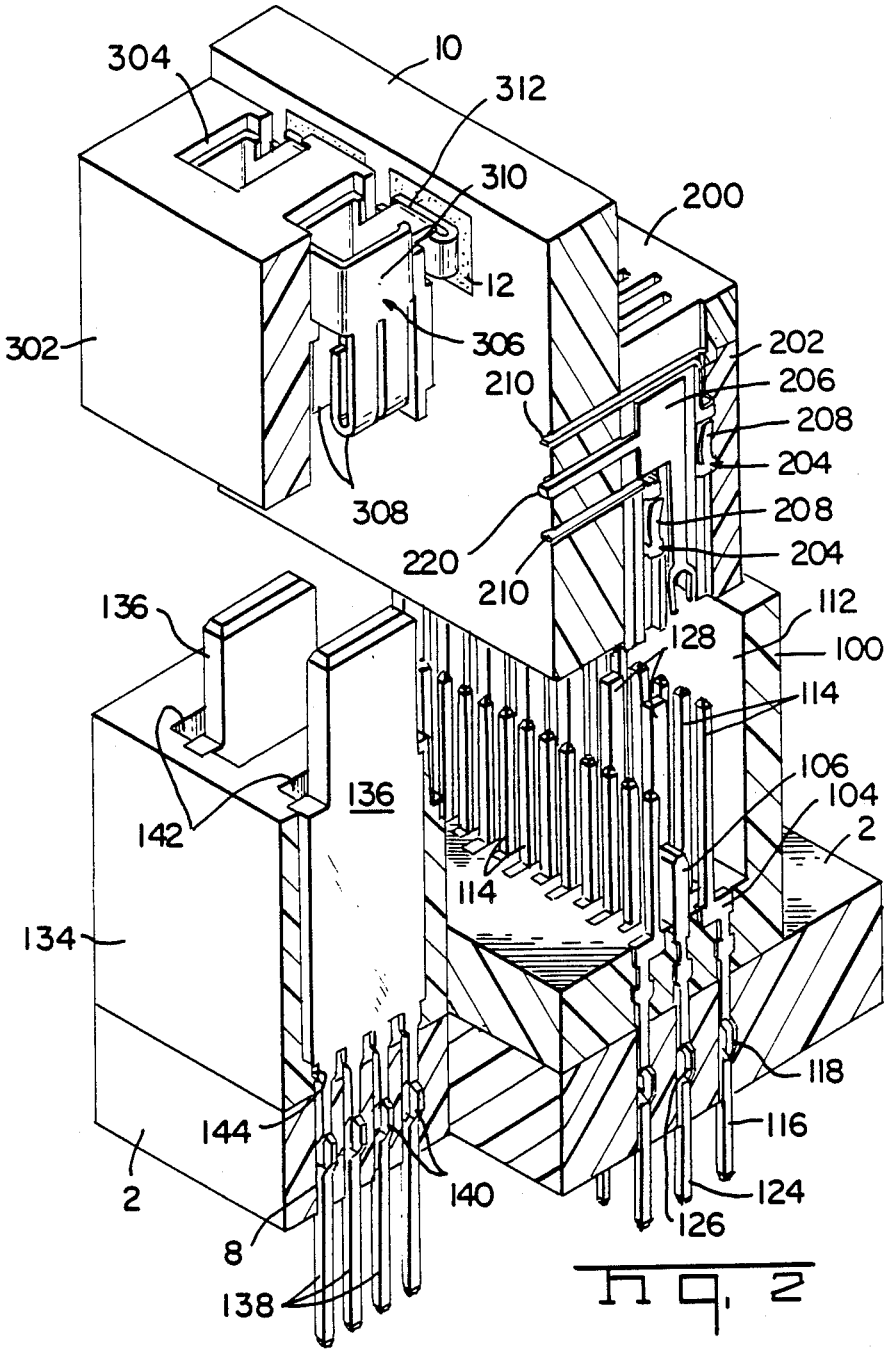
FIG. 2 is an exploded perspective view of the motherboard connector with the daughterboard power and signal connectors positioned for mating.
Figure 7:
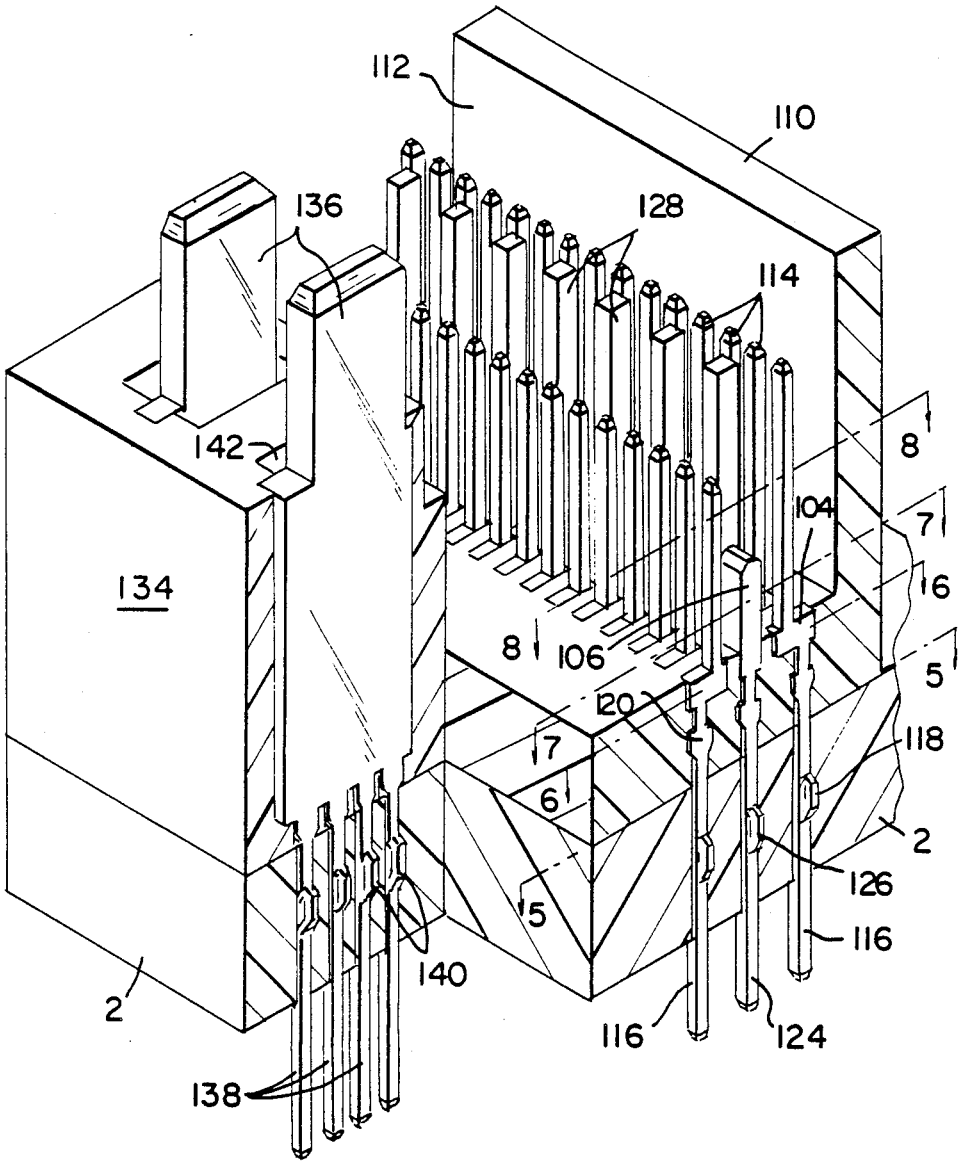
FIGS. 5–8 are section views taken along section lines 5—5, 6—6, 7—7, and 8—8 in FIG. 3, showing the position of the ground and signal contacts in the motherboard backplane connector and the daughterboard signal connector.
Figure 4A:
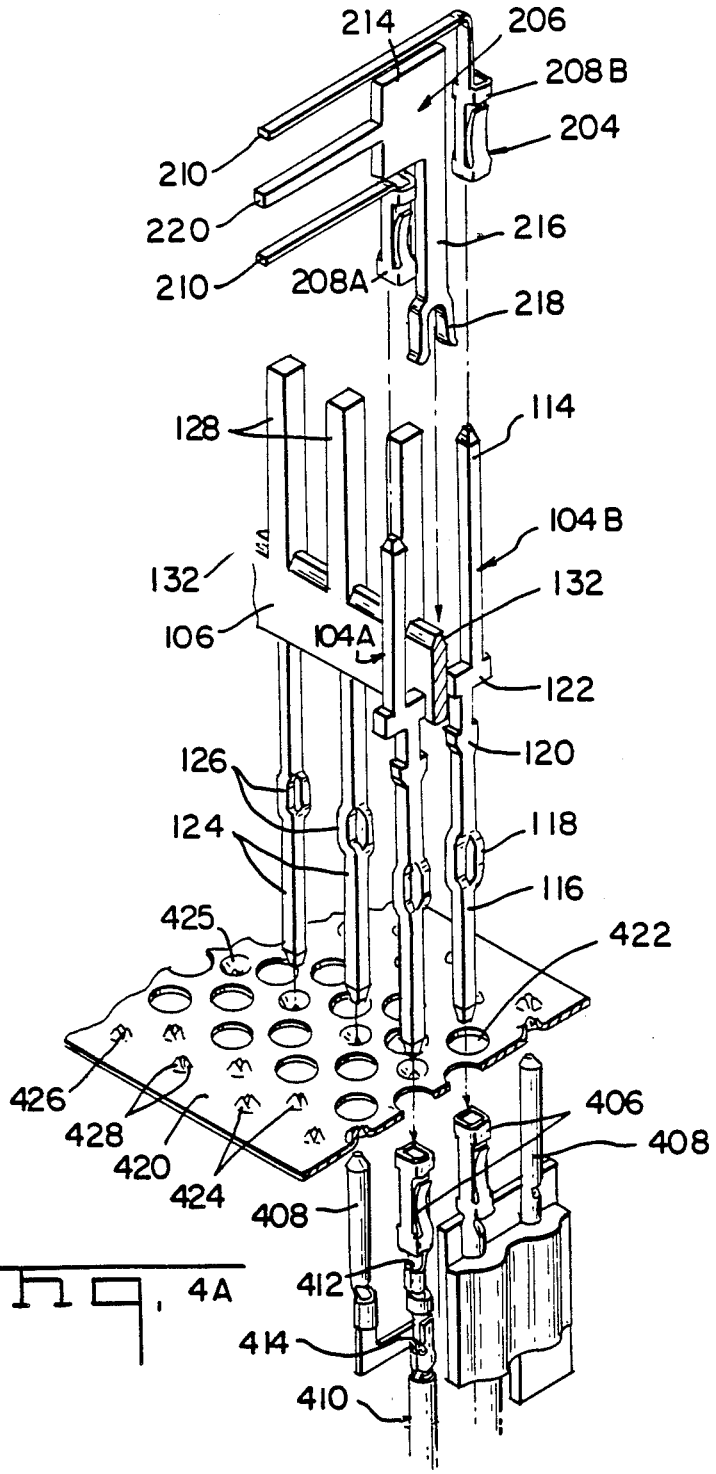
FIGS. 4A and 4B are exploded perspective views showing the motherboard signal and ground contacts and daughterboard contacts at adjacent positions. The coaxial input contacts and the coaxial input connector ground plane are also shown.
Figure 4B:
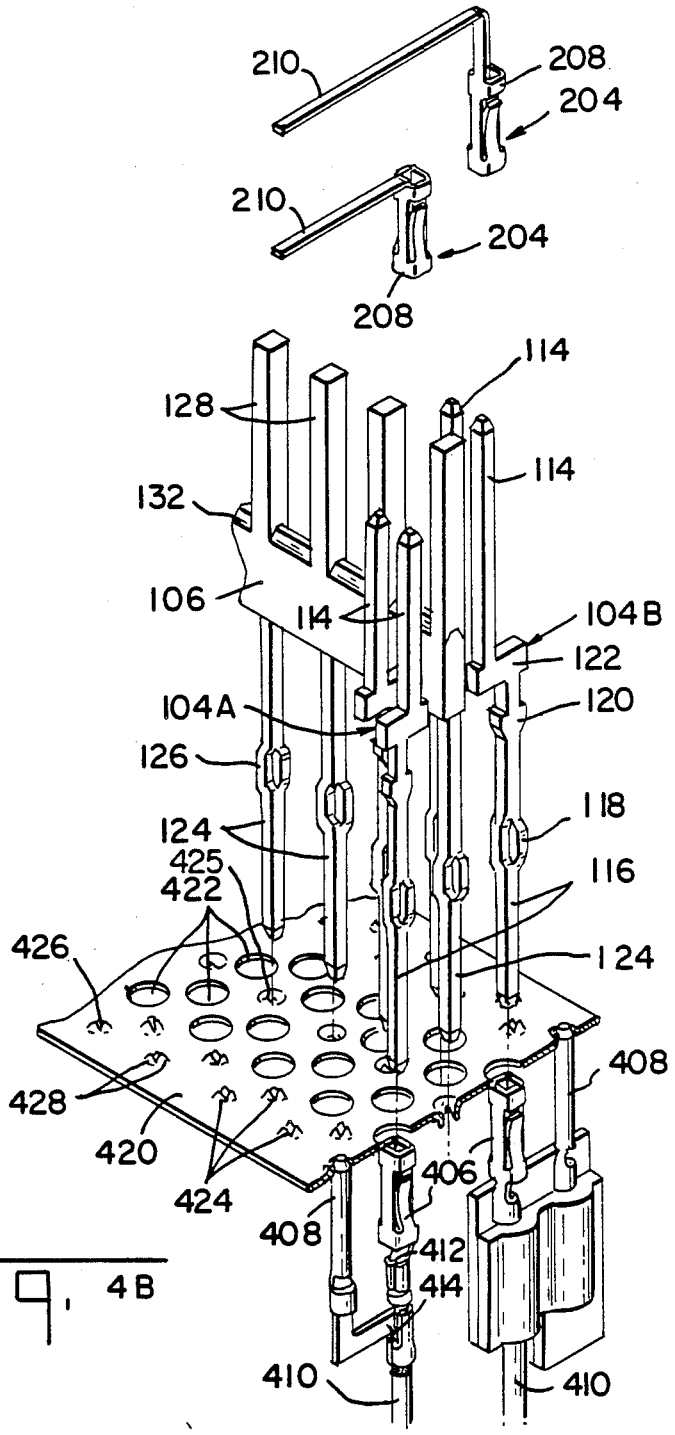
Figure 4C:
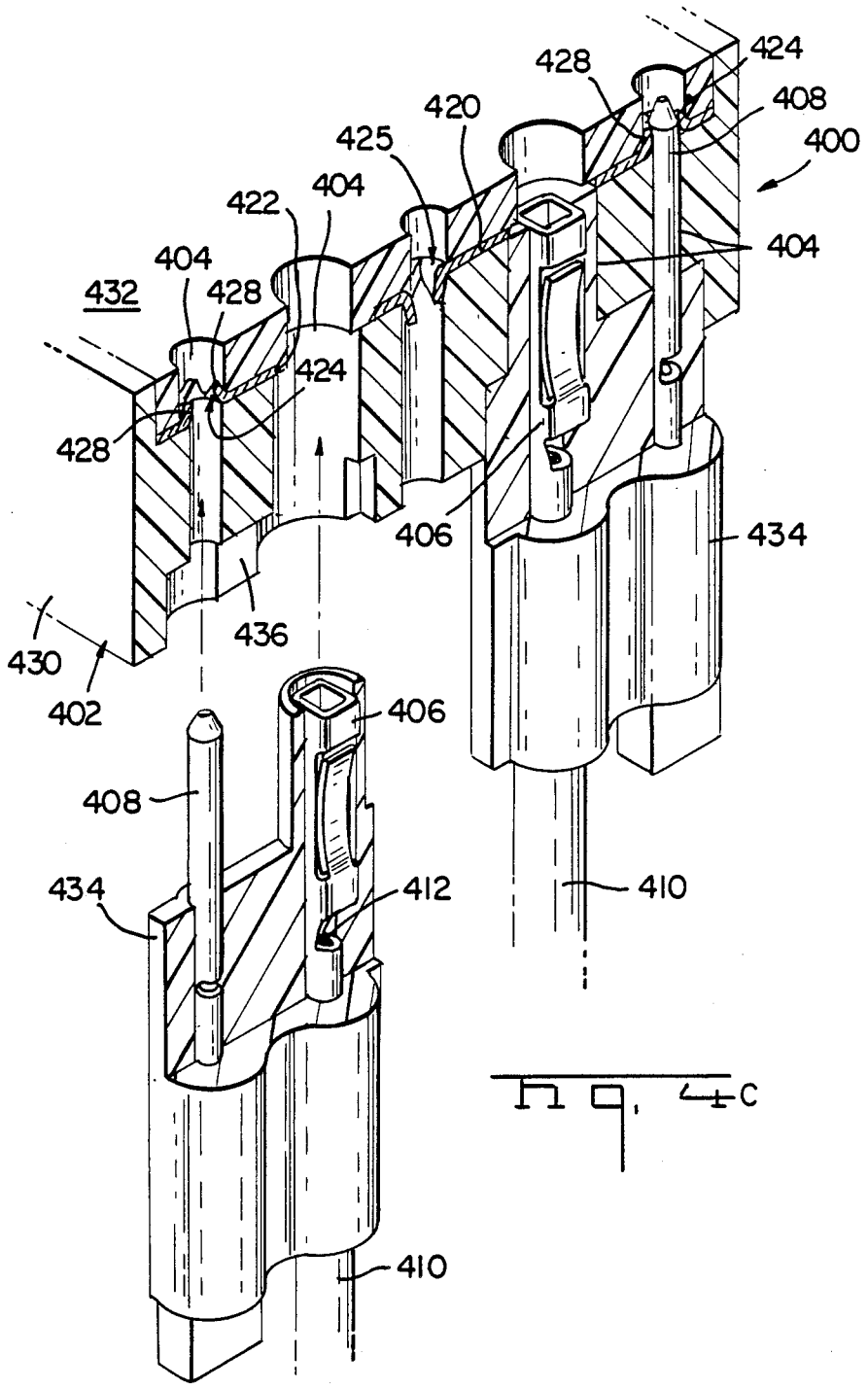
FIG. 4C is a perspective view, partially in section showing the insulative sleeves received within cutouts in an insulative base member.
Figure 7:
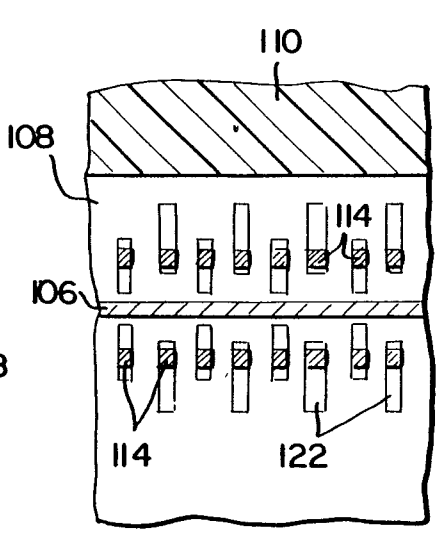
Figure 6:
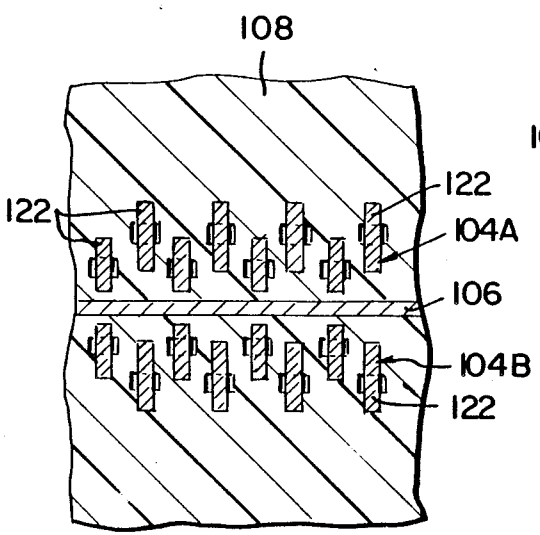
Figure 5:
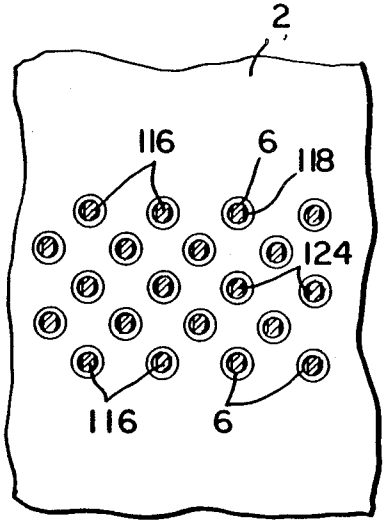
Figure 9:
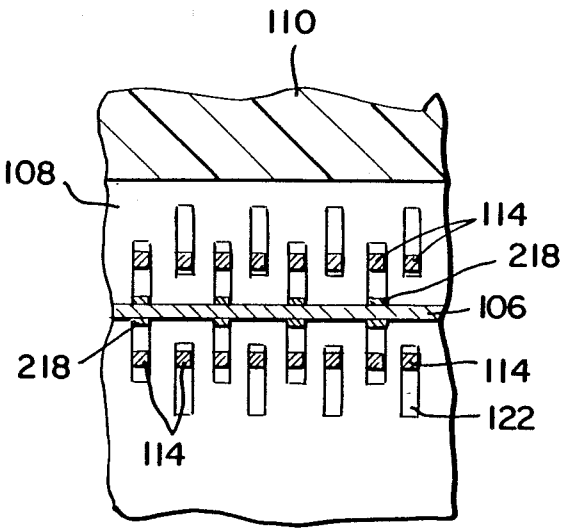
FIG. 9 is a section view similar to FIG. 8, but showing the mated configuration of the motherboard backplane connector and the daughterboard signal connector.
Figure 8:
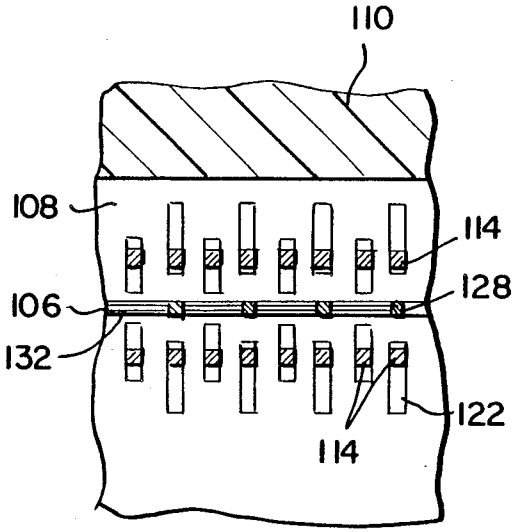

Motherboard Backplane Connector (Signal Section) (See FIGS. 1–3)

The motherboard backplane connector 100 has a plurality of signal contacts 104 and a ground plane contact or ground bus 106, each mounted in an insulative housing 102 formed from a material such as Ryton. The insulative housing 102 has a base 108 through which both the signal contacts 104 and the ground bus 106 extend and a lateral upwardly extending wall 110 which forms a cavity 112 along the upper side of the motherboard backplane connector 100. Each signal contact 104 is in the form of a pin having an upper section 114 and a lower section 116. The lower section 116 of each signal pin 104 includes a spring contact 118 adapted to make interconnection with a plated through hole 4 in the printed circuit motherboard 2. It should be understood, however, that the lower portion 116 of the signal contacts 104 can have other configurations, such as a conventional solder pin configuration. The lower portion 116 of each signal pin contact 104 has barbs 120 for securing the signal contact pin 104 in the lower base 108 of the insulative housing 102 of the motherboard backplane connector 100. The lower section 116 of each signal pin contact 104 is offset from the upper pin section 114 by a central dogleg 122, which is located at the top of the base 108. Since the upper pin section 114 and the lower pin section 116 can extend from the dogleg 122 at different points, the signal contact pins 104 can be formed so that the upper sections 114 are in line whereas the lower pin sections 116 are offset or staggered.

Four rows of lower contact pins 116 are formed with the lower pin sections 116 in adjacent rows being mutually spaced apart by a distance of 0.100 inch. Note, however, that the upper contact pin sections 114 are all spaced in a single row with a spacing of 0.050 inch. Thus, the upper contact pin sections 114 can be closely spaced whereas the lower section 116 can be spaced apart by a distance which makes the fabrication of traces on the printed circuit motherboard 2 easier.

The ground bus 106, positioned between inner and outer rows 104A and 104B of signal contact pins 104, also has a plurality of depending legs 124 which are of the type suitable to form a spring contact with plated through holes 6 in a printed circuit motherboard 2. As with the signal contact pins 104, these spring contacts 126 can be replaced by a through hole solder pin configuration. The single ground bus 106 formed in the motherboard backplane connector 100 extends laterally along the length of the base 108 and extends upwardly into the cavity 112 formed on the upper side of the insulative housing 102. A plurality of posts 128 spaced apart by a distance of 0.100 inch extends upwardly from the upper portion of the ground plane contact or bus 106. Ground pins or legs 124 extend downwardly from the ground bus 106. The width of these pins is the same as the width of the ground plane bus 106. A beveled section 132 is formed on the upper edge of the bus 106 between adjacent upstanding posts 128. The motherboard backplane connector 110 is configured such that the upper signal contact pins 114 are equally spaced apart from the ground bus 106. The lower signal contact portions 116 are, however, spaced from the ground plane legs or pins 124 by different distances.

Daughterboard Backplane Signal Connector (See FIG. 1)

The daughterboard backplane signal connector 200 has an insulative housing 202 formed of a material such as Ryton and has a plurality of signal and ground contacts, 204 and 206 respectively, positioned therein. The signal contacts 204 each have a box type receptacle 208 similar to the receptacle 406 employed in the coaxial connector 400. The signal contacts 204 each have signal contact legs 210 extending at right angles with respect to the receptacle contact portion 208. Since the length of the upper portion of the signal pins 114 in the motherboard backplane connector 100 is longer for the rows 104B on the outer portion of the ground plane bus 106 than for rows 104A on the inner side of the ground plane 106, the receptacle contact portions 208 are not located at the same height. The legs 210 extending from the receptacle portions of the daughterboard signal contacts are staggered in a similar configuration to the lower signal sections 116 of contacts 104 which establish interconnection to the traces on the motherboard 2.

Instead of a single continuous ground plane in the daughterboard signal connector 200, a plurality of ground blades 206 are located between the signal legs 210 having the greatest spacing. Each blade 206 and corresponding receptacle 208 has a central section 214 with a lower vertically extending segment or arm 216 which extends between the receptacle portions 208*b* of the signal contacts in the outermost rows. This vertically extending arm of the blade has a bifurcated spring contact 218, located at its lower end, suitable for establishing a resilient contact with the base of the ground plane bus 106 in the motherboard connector 100. The central section 214 of each blade 206 extends above the innermost receptacles 208*a* and includes a horizontal arm segment 220 extending adjacent to the right angle portion of the leg 210 of the outermost receptacle contact 208*b*. These ground blades 206 are located only between the daughterboard signal contacts 208*b* having legs spaced apart by a distance greater than the contacts relatively more closely spaced apart. Note that the leg 216 of each ground blade 206 is surrounded by six equally spaced signal contact legs 210 which are arranged in a hexagonal configuration surrounding each ground blade leg 216. Each ground blade 206, when mated with the ground plane 106 of the motherboard connector 100, extends between adjacent upwardly extending posts 128. Note that the ground blade configuration and the ground post configuration forms a spacing between signal contacts 204 and the ground such that a constant impedance is maintained for the signals transmitted including the motherboard backplane connector 100 and the daughterboard signal connector 200 through the backplane connector assembly.

Motherboard Backplane Connector (Power Section) (See FIGS. 1-3)

In the preferred embodiment of this invention, the motherboard backplane connector 100 includes a power section integral with the motherboard signal connector section. The motherboard backplane insulative housing 100, in addition to containing apertures for receiving the signal pins 104 and the ground bus pins 124, includes a power section 134 containing a plurality of pockets 142 for receiving male power blades 136 and apertures 144 for receiving through hole legs 138. A plurality of through hole legs 138 extend from each power blade 136 which is located in a pocket 142 on the top of the power section 134 of the insulative housing. The plurality of legs 138 provide ample cross-sectional area for conducting power from the power traces in the motherboard 2 up through the single blade which is located at a right angle relative to the daughterboard 10. Each leg 138 has a resilient integral spring section 140 for contacting the plated through holes 8 in the motherboard 2.

Daughterboard Power Connector (See FIGS. 1 and 2)

The daughterboard power connector 300 is completely separate from the daughterboard signal connector 200. The daughterboard power connector 300 includes a housing 302 containing a plurality of side-by-side cavities 304, each of which receives a single daughterboard power contact 306 which is surface mounted to power traces in the daughterboard 10 through surface mount pads 12. The individual power contacts 306 in the daughterboard power connector 300 each have dual U-shaped contact legs 308 extending downwardly and located at right angles relative to the daughterboard 10. Each U-shaped leg 308 is resilient and is adapted to receive a single blade delivering power from the motherboard 2. Note that the width of the motherboard power blades is such that contact can still be established even though the motherboard power blades are mated at different lateral positions relative to the female daughterboard power contacts 306. Thus, the power configuration is not dependent upon the use of a daughterboard 10 having a specified thickness. The resilient spring legs 308 in the daughterboard receptacle contacts 306 project downwardly from a box section 310 in the stamped and formed power contact 306 A surface mount foot 312 having a reversely bent configuration extends orthogonally relative to the box section 310 to establish contact with a surface mount power pad 12.

We claim:

1. An electrical connector assembly for interconnecting a plurality of coaxial conductors to an array of ground and signal pins in a printed circuit board assembly, the connector assembly including:

a plurality of signal contacts each attachable to a signal conductor in a coaxial conductor and including means for establishing contact with a signal pin;

a plurality of ground contacts, each attachable to a braid surrounding the signal conductor in a coaxial conductor; and a ground plate having a plurality of first, second and third apertures, each said first aperture being larger than a signal pin so that the said signal pin can be inserted therethrough without engaging the said ground plate; each said second aperture having means for engaging a ground contact inserted therethrough; each said third aperture including means for engaging a ground pin inserted therethrough, said means for engaging a said ground contact and a said ground pin respectively in the said second and third apertures comprising a plurality of tabs having tapered edges, said tabs in said second apertures extending from one side of said ground plate and said tabs in said third apertures extending from the opposite side of said ground plate, said ground contacts being insertable into the second apertures and said ground pins being insertable into said third apertures from opposite sides of said ground plate.

2. The connector assembly of claim 1 wherein the said ground plate is embedded in an insulative member, the said insulative member having holes aligned with the said first, second and third apertures.

3. The connector assembly of claim 2 wherein the said insulative member includes a base member and a cover, the said ground plate being held between the said base member and the said cover.

4. The connector assembly of claim 3 wherein the said second and third apertures are formed by transverse slits in the said ground plate, said aperture tabs being formed by the slits projecting out of the plane of the said ground plate.

5. The connector assembly of claim 4 wherein the said signal contacts and the said ground contacts are surrounded by an insulative sleeve.

6. The connector assembly of claim 5 wherein cutouts are formed in the lower surface of the insulative member for receiving the said insulative sleeves.

7. The connector assembly of claim 1 wherein the said third apertures are arranged in a central row.

8. The connector assembly of claim 7 wherein the said first apertures are arranged in a plurality of staggered rows on opposite sides of the said central row.

9. The connector assembly of claim 8 wherein the said second apertures are arranged in a plurality of staggered rows beyond the staggered rows of the said first apertures.

10. The connector assembly of claim 2 wherein the said means for establishing contact with the signal pin comprises a receptacle, the said receptacle being received within cutouts in the said insulative member aligned with the said first aperture.

11. The connector of claim 6 wherein the said cutouts intersect aligned first and second apertures.

12. The electrical connector of claim 1 wherein each said tab is arcuately formed between said tapered edges.

13. An electrical connector for interconnecting a plurality of electrical contacts, the connector comprising a conductive plate having a plurality of apertures, each said aperture having means for engaging a single contact, said engaging means comprising tabs having edges defined by slits, the tabs deflecting when said contacts are inserted therein, wherein said tabs of different said apertures extend from opposite sides of the said conductive plate, contacts being insertable into the said plate apertures from opposite sides.

14. The electrical connector of claim 13 wherein the said conductive plate is positioned within an insulative member.

15. The electrical connector of claim 14 wherein the said insulative member comprises a base member and a cover member, the said conductive plate being positioned between the said base member and the said cover member.

16. The electrical connector of claim 13 wherein the said tabs are defined by transverse slits, each said tab initially being bent out of the plane of the said conductive plate.

17. The electrical connector of claim 13 wherein each said tab is bent sufficiently out of the plane of the said conductive plate so that a contact inserted therein engages the side of the said tab.

18. The electrical connector assembly of claim 13 wherein each said tab is arcuately formed between edges of each said tab.

* * * * *